United States Patent [19]

Heichlinger et al.

[11] 3,999,366

[45] Dec. 28, 1976

[54] SLUB YARNS OBTAINED FROM BLOWING AND SUCKING PROCESS

[75] Inventors: Norbert Heichlinger, Munich; Karl Andiel, Bobingen, both of Germany

[73] Assignee: Hoechst Aktiengesellschaft, Frankfurt am Main, Germany

[22] Filed: Nov. 15, 1974

[21] Appl. No.: 524,065

Related U.S. Application Data

[62] Division of Ser. No. 322,136, Jan. 9, 1973, Pat. No. 3,854,313.

[30] Foreign Application Priority Data

Jan. 11, 1972 Germany ..... 2201147

[52] U.S. Cl. ..... 57/140 J; 57/157 F; 428/399

[51] Int. Cl.[2] ..... D02G 3/34

[58] Field of Search ..... 57/34 B, 91, 140 J, 57/157 F; 28/1.4, 72.12; 428/397–400

[56] References Cited

UNITED STATES PATENTS

| | | | |
|---|---|---|---|
| 3,122,816 | 3/1964 | Rhoden | 28/72.12 |
| 3,433,007 | 3/1969 | Myers | 57/140 J |
| 3,474,613 | 10/1969 | Joarder et al. | 57/34 B |
| 3,517,498 | 6/1970 | Burellier et al. | 57/157 F X |
| 3,591,955 | 7/1971 | Fujita et al. | 57/157 F |

*Primary Examiner*—John Petrakes
*Attorney, Agent, or Firm*—Connolly and Hutz

[57] ABSTRACT

A process for the manufacture of slub yarns obtained from continuous filaments, which comprises feeding continuous filaments through the inlet orifice of a guide tube at a feed rate superior to the withdrawal rate at the outlet orifice, and sucking them into a connecting tube by means of a sucking jet in such a manner that an increasingly enlarging open loop is formed; wherein a gaseous medium, in intervals and periods of time programmed by a control system, is blown into the connecting tube, thereby passing through the feeder tube of a blowing jet mounted to the end of the connecting tube which is adjacent to the guide tube; the gaseous medium causing a ligature of the neck of the open loop of the yarn, which loop so ligatured is subsequently united over its total length with the continuous filament.

20 Claims, 3 Drawing Figures

SLUB YARNS OBTAINED FROM BLOWING AND SUCKING PROCESS

This is a divisional application of Ser. No. 322,136, filed Jan. 9, 1973, now U.S. Pat. No. 3,854,313.

The present invention relates to slub yarns and a process for the manufacture of slub yarns made from continuous filaments, which comprises feeding continuous filaments through the inlet orifice of a guide tube at a feed rate superior to the withdrawal rate at the outlet orifice, and sucking them into a connecting tube by means of a sucking jet in such a manner that an increasingly enlarging open loop is formed. The present invention relates also to a device for carrying out this manufacturing process.

For a series of applications, those yarns are advantageous which show great variations of titer, as in the case of some kinds of natural silk. Since these natural silks cannot longer meet the increasing demand, it is tried for a certain time already to manufacture yarns having a similar aspect which can be industrially produced on a large scale from synthetic filaments in unlimited quantities. These yarns are for example required for curtain or covering fabrics or other decorative materials, but also for ladies' dress goods, where fabrics having an especially expressive structure are described.

In order to close this gap in the market, processes have been developed which ensure the manufacture of synthetic yarns having irregularly placed slubs.

In some of these processes for example, these yarns are manufactured by introducing a yarn into a feed jet through which it is blown against a screen permeable to air (U.S. Pat. No. 3,296,785), which may have different porosities (U.S. Pat. No. 3,474,613), while from a second jet an air stream is blown in a counter-current against the screen, thus creating a turbulent zone in which slubs may form in the yarn. The slub yarn so obtained is united with a second yarn, and both yarns are pressed through a ply-interlacing jet and subsequently forwarded to a false twisting device.

In U.S. Pat. No. 3,116,589, a process is described wherein one or more yarn bundles are blown onto a screen simultaneously with an air stream; a second air stream coming from another jet is directed on the screen, and this stream, at a converging angle to the first one, produces the formation of slubs in the filaments. The slub yarn so obtained is then withdrawn by a conveying device in a counter-current direction to the second air stream, and subsequently wound up.

U.S. Pat. No. 3,174,271 describes the properties of the yarn obtained in accordance with U.S. Pat. No. 3,116,589. The yarn has slubs the size and distribution of which are entirely random. The yarn should contain at least 50 of such slubs per 914 m (1000 yards) of yarn; the average length of the slubs being at least 24.5 cm, 10 to 30% of the slubs having lengths of more than twice the average. The slubs have an average titer of at least a triple of the starting titer, while 5 to 65% of the slubs have a titer which is at least 10 times greater than the starting titer.

From U.S. Pat. No. 3,433,007 it is known to manufacture a yarn from synthetic filaments which contains irregularly distributed slubs of random size, by continuously aspirating a yarn bundle of continuous filaments, by means of an air stream, into a chamber providing an air turbulence, and by continuously withdrawing the yarn from this chamber at reduced speed. Before striking the withdrawing device, the slub yarn may be interlaced in order to set the slubs. Subsequently, the slub yarn is wound up.

All these known processes for the manufacture of slub yarns and the devices used in these processes provide slub yarns having slubs the size and distribution of which is entirely random. Yarns are obtained containing the desired slubs in completely irregular form and distribution, which means that the slubs may crowd in some sections of the yarn, while there are none or too small a number in other sections. Moreover, the slubs may be too short, so that they appear as knots, or they may be too long, so that they extend over more than one filling yarn and thus give the fabric a faulty aspect. In all these cases fabrics are obtained which do not meet the requirements, since they do not possess the desired structure as known from the titer differences of natural silk.

Moreover, it has been observed that these yarns often contain so-called interlaced spots which clearly appear as flaws in the fabric. The reason for these flaws are interlaced monocapillaries in the yarn sections between the slubs, which sections are interlaced in the same manner as the slubs themselves.

It is therefore one object of the present invention to provide slub yarns and a process and a device for carrying out this process which permit programming of the number and length of the slubs in the yarn. It is a further object to provide slub yarns made by a process allowing a controlled manufacture of slub yarns, wherein the length of the slubs may be determined in accordance with the later application of the yarn, and which comprises distributing the slubs as desired so that they appear in agreeable form in the finished fabric. A further object of this invention is to provide a slub yarn which, while being woven, neither does cause a faulty aspect of the fabric on account of slubs crowded nor show undesired interlaced spots.

Novel features and advantages of the present invention will become apparent to one skilled in the art from a reading of the following description in conjunction with the accompanying drawings wherein similar reference characters refer to similar parts and in which.

Figure 1:
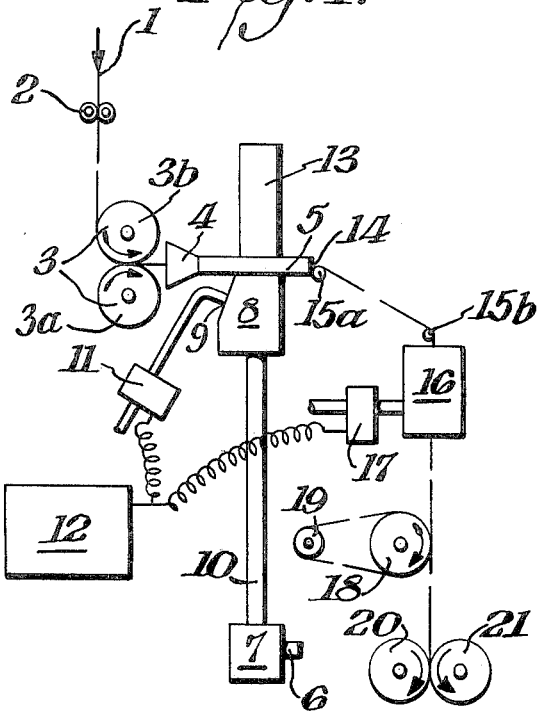
FIG. 1 is a schematic diagram of apparatus performing a process for obtaining a slub yarn which is one embodiment of this invention.

These objects of the present invention are attained by blowing a gaseous medium, in intervals and periods of time programmed by a control system, into connecting tube 10 of the drawings, thereby passing through feeder tube 9 of blowing jet 8 mounted to the end of connecting tube 10 which is adjacent to guide tube 5; the gaseous medium causing a ligature of the neck of the open loop of the yarn, which loop so ligatured is subsequently united over its total length with the continuous filament.

In a preferred embodiment of the process of the invention, the gaseous medium is blown by means of blowing jet 8 in the suction direction of sucking jet 7.

In a further preferred embodiment, the gaseous medium in blowing jet 8 is blown in a counter-current to the suction direction of sucking jet 7.

Preferably, the loops ligatured at their neck are united over their total length with the continuous filament by interlacing, using a gaseous medium. For interlacing the loops ligatured at their neck with the continuous filament it is especially advantageous to introduce the gaseous medium into interlacing jet 16 in a discontinuous manner, in the same intervals and periods of time programmed, but with such a time lag as compared to the feed of blowing jet 8 that the loop ligatured only at its neck is completely united with the continuous filament in interlacing jet 16.

In all these variations of the process of the invention, an additional continuous filament may be fed to interlacing jet 16.

The device for carrying out the process of the invention contains a blowing jet 8, to which is fed a controlled intermittent gas stream via feeder tube 9, a guide tube 5 having a funnel shaped inlet orifice 4 and a cylindrical top 13, furthermore a connecting tube 10, a sucking jet 7 provided with feeder tube 6.

The distance between inlet orifice 9*a* of feeder tube 9 of blowing jet 8 and the end 25 of connecting tube 10 is advantageously greater by preferably a third than the longest slub to be produced.

It is especially advantageous to connect blowing jet 8 and interlacing jet 16 to a control system, preferably to magnetic valves 11 and 17 respectively, and to an aperiodic pulse generator 12 controlling the activity of blowing jet 8 and interlacing jet 16 by means of magnetic valves 11 and 17.

By aperiodic pulse generator there is to be understood any generator which, within optional limits, transmits pilot pulses in substantially random intervals of time. These intervals must not correspond exactly to random numbers of a purely mathematical signification, as they are defined in Handbook of Mathematical Functions of the National Bureau of Standards of the U.S.A., 1964, and not to the pseudo-random numbers indicated in the same handbook.

A simple and advantageous aperiodic pulse generator is the installation which is described in its details in the examples, wherein several astable multivibrators are connected by means of an AND-gate in such a manner that a pilot pulse is created only in the moment where all multivibrators transmit their starting pulse simultaneously. Although these pulse generators possess a periodicity of that time T which corresponds to the smallest common integer multiple of the periodicities of the single multivibrators, this periodicity period varies because of the astability of each of the circuit elements. By further connections, an upper and lower limit each of the pilot pulse sequence may be determined.

The combination of devices necessary for carrying out the process of the invention will be better understood by reference to the drawing of FIG. 1, which is a schematic representation of the above combination of devices. It shows filament guide 2, feed rollers 3, guide tube 5 with cylindrical top 13, blowing jet 8 with feeder tube 9 in oblique position, magnetic valve 11 and aperiodic pulse generator 12 series-connected to it, furthermore connecting tube 10 and sucking jet 7. The combination of devices comprises also interlacing jet 16 for setting the slubs, which process step has best results in the case where the filament inlet orifice of interlacing jet 16 is at a preferred distance of from 50 to 600 mm from the spot where the gas stream in blowing jet 8 strikes the open loop. The combination of devices comprises furthermore magnetic valve 17 inserted in the gas stream feeder tube, godet 18 with idler roll 19 and wind-up device 20/21.

In the manufacturing process of the slub yarn having a programmed slub size and distribution according to the present invention, referring to FIG. 1, a continuous multifilament 1 is forwarded first to a device for forming loops, thereby passing through filament guide 2 and feed rollers 3 which may consist of feed roll 3*a* and contact roll 3*b*. The continuous filament passes through funnel shaped inlet orifice 4 into guide tube 5. Since the withdrawal rate of the continuous filament is lower than that of the feed, the filament accumulates in guide tube 5. By continuously feeding in compressed air through feeder tube 6, a depression is produced in sucking jet 7, which sucks the overfed continuous filament in the form of an open loop through blowing jet 8 into subsequent connecting tube 10 connecting sucking jet 7 with blowing jet 8. Each time when a short duration gas stream is introduced into blowing jet 8 through feeder tube 9, which in accordance with this invention may be effected by means of magnetic valve 11 inserted into the gas feeder tube, which valve is for example controlled by aperiodic pulse generator 12, the open loop of the continuous filament is closed by this gas stream pulse. The length of this loop is determined by the time interval between two gas stream pulses and the difference of filament feed and withdrawal rate. The loop leaves blowing jet 8, enters partially and temporarily in cylindrical top 13 and passes then through outlet orifice 14 over guide pins 15*a* and 15*b* to interlacing jet 16, while the gaseous medium escapes through cylindrical top 13 and connecting tube 10. Interlacing jet 16 is fed with gaseous medium by means of the same control mechanism and magnetic valve 17 in a time lag over blowing jet 8 to be determined in each case, so that the gas stream pulses striking the yarn interlace the loops formed with the continuous filament and thus set them, while the yarn sections between the slubs are substantially maintained in their original state. The slub yarn so obtained is withdrawn by means of godet 18 and idler roll 19 and wound up on bobbin 21.

Suitable starting materials for the process of the invention are all yarns made from synthetic high polymers, for example from polyamides, polyacrylonitrile, but above all yarns made from high molecular weight polyesters, for example polyethylene terephthalate, having filament titers of from 1.0 to 10.0 dtex, especially from 1.3 to 3.0 dtex, and total titers of from 50 to 3000 dtex, especially from 100 to 400 dtex. The starting material may be drawn filaments withdrawn from the drawing cop and fed to the described installation of devices, or the spun yarn is used which is drawn immediately before processing and forwarded directly to the blowing jet without winding it up after drawing. Within the cited range or titers, the filaments used may be thin yarns having few monocapillaries, or several of these thin yarns may be fed in simultaneously, so that a thicker yarn having many monocapillaries is formed. Anyway, the yarns used should be employed in a zero twist form or only slightly twisted.

According to this invention, it is possible to use continuous filaments having a latent crimp. This latent crimp may be developed by known methods either in the course of the manufacturing process of the slub yarn, or after it in the finished yarn, or later in the fabric itself.

The manufacturing process of the present invention is generally carried out at a feed rate of the yarn of from 100 to 1000 m/min, preferably from 300 to 800 m/min. The feed rate may also exceed these limits, but the feed rate of feed rollers 3 must always be higher than the withdrawal rate of godet 18, so that loop formation is possible. This difference between feed rate in m/min and withdrawal rate in m/min is the overfeed, which is indicated in percent and defined as follows:

$$\text{overfeed (\%)} = \frac{\text{feed rate} - \text{withdrawal rate}}{\text{withdrawal rate}} \times 100$$

The overfeed depends on the desired average length of the slubs and their distribution. A preferred overfeed range is from 3 to 20%.

The gaseous medium forwarded to the blowing jet and the interlacing jet in predetermined time intervals is preferably compressed air, but may be also steam or another gas. Whenever possible, this gas is generally used at normal temperature. In special cases, however, it may be advantageous to use a heated gas, for example when a latent crimp of the filaments is to be simultaneously developed. The gas pressure before the jets is generally from 0.5 to 7.0 atm/g, for the blowing jet is is preferably from 1.0 to 3.0 atm/g, and for the interlacing jet preferably from 3.0 to 6.0 atm/g. The sucking jet is fed with compressed air at a pressure of from 0.8 to 3.0 atm/g.

The gas is fed to the blowing and interlacing jets, respectively, by the control system. This control system may for example consist of two magnetic valves which are inserted in the gas feeder tubes of the blowing and interlacing jets, respectively, and which receive pilot pulses with corresponding time lag by an aperiodic pulse generator. This aperiodic pulse generator may be programmed, within an optional range, with the average number of gas pulses per unit of time, the average time of the breaks between two pulses, and a minimum and maximum break time. By this program, the length and distribution of the slubs within the adjusted range is determined.

The invention, however, is not limited to the cited method of control. It is also possible to use pneumatic control pistons or other suitable devices.

Figure 2:
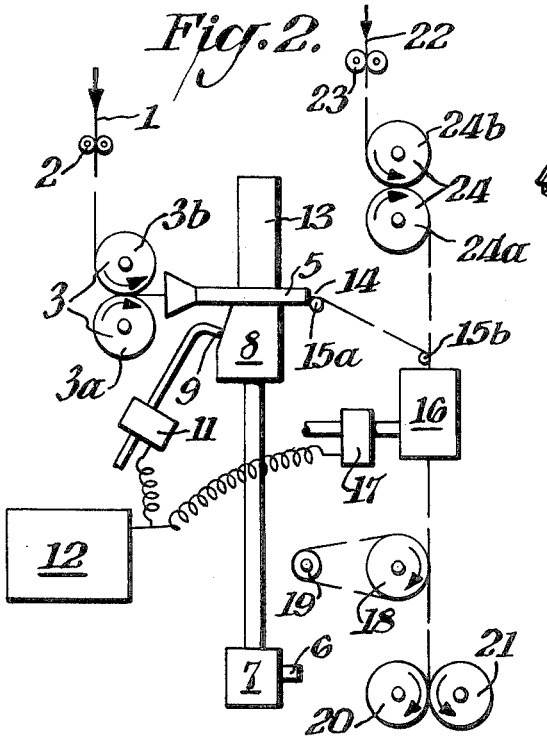
FIG. 2 is another schematic diagram of apparatus performing a process for obtaining the slub yarn which is an embodiment of this invention.
Figure 3:
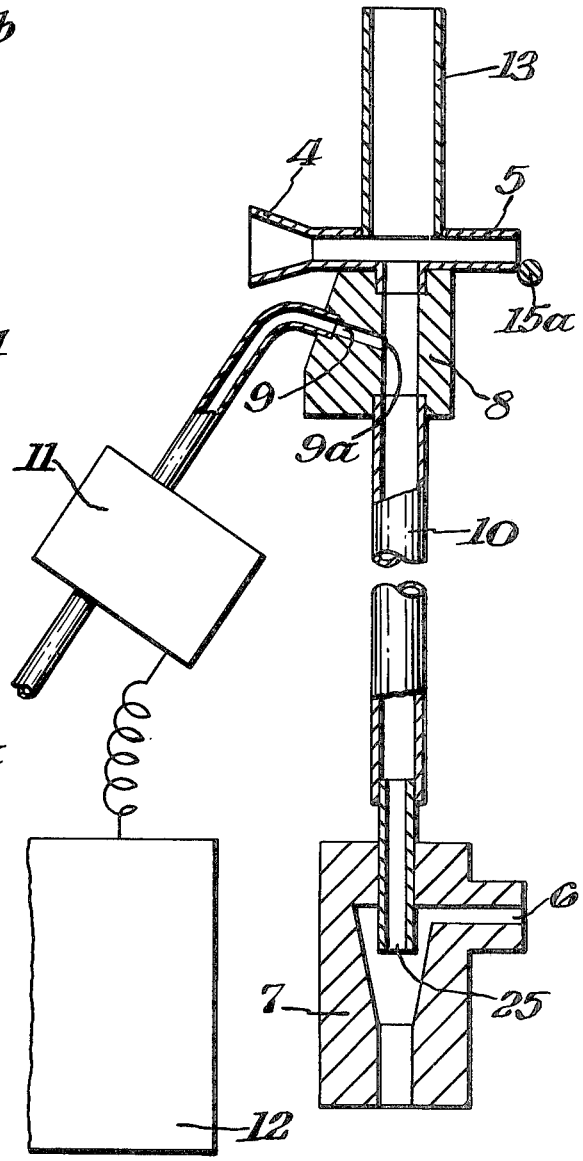
FIG. 3 is an enlarged schematic view partially in cross-section of portions of the apparatus shown in FIGS. 1 and 2.

In the drawings which illustrate the invention, FIG. 3 shows the main parts of the combination of devices in accordance with this invention, and FIG. 2 a modified embodiment of the process of the invention.

FIG. 3 shows blowing jet 8 with guide tube 5, funnel shaped inlet orifice 4, cylindrical top 13 and the control mechanism connected via feeder tube 9, the control mechanism consisting for example of magnetic valve 11 and aperiodic pulse generator 12. The lower part of blowing jet 8 is connected to sucking jet 7 by means of connecting tube 10 which may be of rigid or flexible material. It is especially advantageous to provide the distance between inlet orifice 9*a* of feeder tube 9 of blowing jet 8 and end 25 of connecting tube 10 in such a manner that is at least 1.3 times greater than the longest slub to be produced. Sucking jet 7 is provided with feeder tube 6 through which a continuous air stream is fed in to cause the desired depression.

In a modified embodiment of the process of the invention, an additional yarn is combined with the slub yarn. FIG. 2 showns the corresponding combination of devices which in principle corresponds to the installation of FIG. 1, but is completed by filament guide 23 and feed rollers 24. The additional filaments have a titer of from 30 to 1000 dtex, preferably from 50 to 200 dtex. It is without importance for the process of the invention whether this additional filament is a continuous filament made from synthetic high polymers or a fiber yarn made from natural or synthetic fibers. Additional filament 22, passing through filament guide 23 and feed rollers 24 consisting of feed roll 24*a* and contact roll 24*b* is forwarded to interlacing jet 16, through which it passes together with the slub yarn. Interlacing jet 16 and blowing jet 8 receive short time pulses of a gaseous medium in the same time intervals, which pulses set the slubs and unite the additional filament with the slub yarn. Withdrawal of the set slub yarn is carried out by means of godet 18 with ider roll 19, and the yarn is wound up by means of wind-up device 20/21.

The feed rate of the additional filament normally is not inferior to the withdrawal rate, preferably the same, but it may be adjusted to be up to 1% superior to the withdrawal rate.

The process of the invention provides slub yarns the slubs of which generally have a titer three to four times that of the starting yarn. The strength of the slub yarns obtained is generally sufficient for the subsequent processing and the manufacture of the fabrics. For applications requiring an especially high filament strength, it is advantageous to manufacture a slub yarn with additional filament which provides greater strength. Immediately after their manufacture, the slub yarns may be sized.

The novel process of the invention permits a series of modifications, for example with respect to filament feed, withdrawal, number of blowing pulses per unit of time and break times between the pulses. The process thus presents the advantage of allowing the manufacture of various yarns, each giving the finished fabric a different structure. It is possible to manufacture yarns the slubs of which may differ in their varied average length or in their distribution, or yarns containing slubs of nearly the same length placed at equal distance. These yarns are especially appropriate for the manufacture of decorative fabrics and fabrics of rustic character. Furthermore, by correspondingly programming the slubs, the process of the invention prevents the faulty aspect of the fabrics occuring hitherto above all because of too short or too long slubs.

The following examples illustrate the invention.

EXAMPLE 1

Using the installation of FIG. 1, a zero-twist multifilament yarn made from polyethylene terephthalate, having a titer of 200 dtex and 140 monocapillaries is forwarded, at a rate of 430 m/min, to the blowing jet where loops are formed. The blowing jet is fed with compressed air at 2.15 atm/g, the sucking jet with compressed air at 1.9 atm/g, and the interlacing jet with compressed air at 5.2 atm/g.

The blowing jet and the interlacing jet are not fed with a constant air stream, but single air pulses, about 113 per minute, are transmitted to them. The blowing time of such an air pulse is adjusted to 0.07 seconds in the aperiodic pulse generator, and the breaks between the air pulses are programmed to be from 0.1 to 0.9 seconds, so that the duration of the breaks varies within the predetermined time range.

The aperiodic pulse generator consists of four astable multivibrators having a periodicity of 101, 139, 219 and 262 msec respectively, at the same duration of each pulse and break. Each pilot pulse of this generator sets off three monostable multivibrators; the first adjusts the time of air pulse to 0.07 seconds, the second limits the time interval betweem two air pulses to a minimum of 0.1 seconds, and the third, after a break of 0.9 seconds, sets off an air pulse if in the meantime there has been no pilot pulse from the generator; i.e. it determines the upper limit of the breaks. The periodicity of this aperiodic pulse generator is calculated to be 805,529,724 msec, i.e. more than 9 days. In the measuring times examined, more than 50% of all pulses were from 150 to 350 msec, only 4% were from 700 to 900 msec.

The finished slub yarn leaving the interlacing jet is conveyed to the wind-up device by means of the withdrawing godet at a rate of 408 m/min.

500 Slubs of the yarn so manufactured have a length of from 17 to 159mm. Most frequent are slubs having a length of about 53 mm. and they are from 3.07 to 3.91 times thicker than the titer of the starting yarn. The yarn sections between the slubs have a length of from 1.1 to 6.5 m. For about 99% of the slubs so prepared, a tensile strength of from 200 to 800 g is obtained.

EXAMPLE 2

In the installation as shown in FIG. 2, a continuous multifilament yarn made from polyethylene terephthalate, having a titer of 200 dtex and 140 monocapillaries, is converted to a slub yarn, thereby maintaining the data as adjusted in Example 1. In the interlacing jet, this slub yarn is interlaced with an additional yarn having a titer of 70 dtex and 50 monocapillaries, which yarn is fed into the interlacing jet by means of a second feed mechanism at a rate of 408 m/min. The slub yarn obtained is withdrawn by the withdrawal godet at a rate of 408 m/min and wound on the wind-up device.

The yarn so obtained has the same distribution of slubs as the yarn described in Example 1, but the slub effect is slightly reduced by the additional yarn. The slubs have a titer being from 2.5 to 3.15 times greater than that of the yarn sections between the slubs. The additional yarn causes also a better setting of the slubs, 99% of which having a strength of at least 350 g.

What is claimed is:

1. Slub yarn from continuous filaments obtained by a process which comprises feeding said continuous filaments at a feed rate superior to the withdrawal rate, and sucking them aside by means of a sucking jet in such a manner that an increasingly enlarging open loop is formed; wherein a gaseous medium, in programmed intervals and periods of time is blown into the open loops; the gaseous medium causing a ligature of the neck of the open loop of the yarn, which loop so ligatured is subsequently united substantially only over its total length with the continuous filaments by means of an interlacing jet to form slubs in the yarn, and the programming being characterized by programming slubs by programmed control pulses which are separated from each other at irregular random intervals and lengths which are close enough together to decorate the yarn and not unduly long by programming the average number of control pulses per unit of time, the average time of the breaks between two control pulses, a minimum and maximum break time and maximum and minimum pulse lengths.

2. A slub yarn as set forth in claim 1 including an additional continuous filament which is introduced into the interlacing jet whereby it is incorporated in the slubs.

3. A slub yarn as set forth in claim 1 wherein the filament titers range from approximately 1.0 to 10.0 dtex and the total titers range approximately from 50 to 3000 dtex.

4. A slub yarn as set forth in claim 1 wherein the filament titers range approximately from 1.3 to 3.0 dtex and the total titers range approximately from 100 to 400 dtex.

5. A slub yarn as set forth in claim 1 wherein the yarn is untwisted.

6. A slub yarn as set forth in claim 1 wherein the yarn is slightly twisted.

7. A slub yarn as set forth in claim 1 wherein the continuous filaments have a latent crimp.

8. A slub yarn as set forth in claim 1 wherein the programming is aperiodic.

9. A slub yarn as set forth in claim 8 wherein about 113 control pulses per minute are provided at a length of about 0.07 second and the breaks between control pulses are from about 0.1 to 0.9 seconds.

10. A slub yarn as set forth in claim 9 wherein the aperiodic pulses have a periodicity of 805,529,724 msec, i.e. more than 9 days.

11. A slub yarn as set forth in claim 1 wherein the slubs have a length of from about 17 to 159 mm.

12. A slub yarn as set forth in claim 1 wherein the slubs have a length of about 53 mm, are from about 3.07 to 3.91 thicker than the titer of the starting yarn, and the yarn between the slubshas a length from about 1.5 to 6.5 m.

13. A slub yarn as set forth in claim 12 wherein the yarn has a tensile strength of from about 200 to 800 g.

14. A slub yarn as set forth in claim 13 wherein the starting yarn is a continuous multifilament yarn of polyethylene terephthalate having a titer of 200 dtex and 140 monocapillaries, an additional yarn being introduced in the interlacing jet having a titer of 70 dtex and 50 monocapillaries, the slubs having a titer approximately between 2.5 to 3.15 times greater than that of the yarn sections between the slubs, and 99% of the slubs having a strength of at least 350 g.

15. A slub yarn as set forth in claim 14 wherein the final slub yarn is withdrawn at a rate of 408 m/min. and wound up.

16. A slub yarn as set forth in claim 15 wherein the additional continuous filament is fed into the interlacing jet by means of a second feed mechanism of a rate of 408 m/min.

17. A slub yarn as set forth in claim 1 wherein the difference between the feed rate and the withdrawal rate comprises an overfeed rate, the overfeed percentage is obtained by dividing the overfeed rate by the withdrawal rate, and the overfeed percentage is approximately from 3 to 20%.

18. A slub yarn as set forth in claim 1 wherein the loops ligatured at their neck are interlaced over their total length with the continuous filaments while the yarn sections between the slubs remain substantially in their original state by interlacing jet pulses programmed at a predetermined time lag after corresponding blowing jet pulses.

19. Interlaced slub yarn having slubs in irregular form and distribution characterized in that the distance between the slubs and that the longitudinal extension of the slubs exhibit a predetermined lower and a predetermined upper limit and that the yarn is interlaced only in the area of the slubs.

20. A slub yarn as set forth in claim 19 wherein the slubs have a length of about 53 mm, are from about 3.07 to 3.91 thicker than the titer of the starting yarn, and the yarn between the slubs has a length from about 1.5 to 6.5 m.

* * * * *